US007140916B2

(12) United States Patent
Sweetland

(10) Patent No.: US 7,140,916 B2
(45) Date of Patent: Nov. 28, 2006

(54) ELECTRICAL CONNECTOR HAVING ONE OR MORE ELECTRICAL CONTACT POINTS

(75) Inventor: Matthew Sweetland, Bedford, MA (US)

(73) Assignee: Tribotek, Inc., Burlington, MA (US)

( * ) Notice: Subject to any disclaimer, the term of this patent is extended or adjusted under 35 U.S.C. 154(b) by 41 days.

(21) Appl. No.: 11/080,304

(22) Filed: Mar. 15, 2005

(65) Prior Publication Data

US 2006/0211295 A1 Sep. 21, 2006

(51) Int. Cl.
*H01R 12/24* (2006.01)

(52) U.S. Cl. ..... 439/595; 439/436

(58) Field of Classification Search ..... 439/492–496, 439/436, 660, 682–683, 930
See application file for complete search history.

(56) References Cited

U.S. PATENT DOCUMENTS

| | | | | |
|---|---|---|---|---|
| 1,012,030 | A | | 12/1911 | Underwood |
| 2,904,771 | A | | 9/1959 | Burtt et al. |
| 2,975,254 | A | * | 3/1961 | Yanagisawa ..... 218/118 |
| 3,197,555 | A | | 7/1965 | Mittler |
| 3,257,500 | A | | 6/1966 | Rusch, Jr. et al. |
| 3,371,250 | A | | 2/1968 | Ross et al. |
| 3,447,120 | A | | 5/1969 | Rask et al. |
| 3,476,870 | A | | 11/1969 | Ross |
| 3,495,025 | A | | 2/1970 | Ross |
| 3,631,298 | A | | 12/1971 | Davis |
| 3,639,978 | A | | 2/1972 | Schurman |
| 3,654,381 | A | | 4/1972 | Copp |
| 3,676,923 | A | | 7/1972 | Reimer |
| 3,702,895 | A | | 11/1972 | de Sio |
| 3,711,627 | A | | 1/1973 | Maringulov |
| 3,909,508 | A | | 9/1975 | Ross |
| 3,927,284 | A | | 12/1975 | Andersson |
| 3,984,622 | A | | 10/1976 | Ross |
| 4,082,423 | A | | 4/1978 | Glista et al. |
| 4,123,899 | A | | 11/1978 | Windelbandt et al. |
| 4,128,293 | A | | 12/1978 | Paoli |
| 4,206,958 | A | | 6/1980 | Hall et al. |
| 4,218,581 | A | | 8/1980 | Suzuki |
| 4,462,657 | A | | 7/1984 | Snowdon et al. |
| 4,463,323 | A | | 7/1984 | Piper |
| 4,508,401 | A | | 4/1985 | Casciotti et al. |
| 4,518,648 | A | | 5/1985 | Miyata et al. |
| 4,568,138 | A | | 2/1986 | McKenzie |

(Continued)

FOREIGN PATENT DOCUMENTS

| | | |
|---|---|---|
| EP | 0 176 607 A | 4/1986 |

(Continued)

*Primary Examiner*—J. F. Duverne
(74) *Attorney, Agent, or Firm*—Wilmer Cutler Pickering Hale and Dorr LLP

(57) ABSTRACT

An electrical connector having one or more electrical contacts for providing an electrical connection to an inserted pin is provided. The electrical connector includes a spring made of electrically conductive material and a loading element attached to the spring and arranged to define an opening for pin insertion. The spring is physically arranged relative to the loading element to create a tension on the loading element. The electrical connector includes at least one conductive wire in electrical communication with the spring. The wire is wound around the spring and the loading element, providing multiple electrical contact points radially inward relative to a center of the opening to provide electrical contact to the inserted pin. When the pin is inserted into the opening, the loading element is tensioned such that the loading element generates a contact force at each contact point.

27 Claims, 5 Drawing Sheets

U.S. PATENT DOCUMENTS

| | | | | |
|---|---|---|---|---|
| 4,639,054 | A | | 1/1987 | Kersbergen |
| 4,651,163 | A | | 3/1987 | Sutera et al. |
| 4,664,185 | A | | 5/1987 | Barnard |
| 4,710,594 | A | | 12/1987 | Walling et al. |
| 4,741,707 | A | | 5/1988 | Mondor, III |
| 4,753,616 | A | | 6/1988 | Molitor |
| 4,755,422 | A | | 7/1988 | Headrick et al. |
| 4,778,950 | A | | 10/1988 | Lee et al. |
| 4,813,881 | A | | 3/1989 | Kirby |
| 4,820,170 | A | | 4/1989 | Redmond et al. |
| 4,820,207 | A | | 4/1989 | Zic |
| 4,929,803 | A | | 5/1990 | Yoshida et al. |
| 4,940,426 | A | | 7/1990 | Redmond et al. |
| 4,956,524 | A | | 9/1990 | Karkow |
| 5,015,197 | A | | 5/1991 | Redmond et al. |
| 5,070,605 | A | | 12/1991 | Daglow et al. |
| 5,073,124 | A | | 12/1991 | Powell |
| 5,109,596 | A | | 5/1992 | Driller et al. |
| 5,163,837 | A | | 11/1992 | Rowlette, Sr. |
| 5,176,535 | A | * | 1/1993 | Redmond et al. ..... 439/495 |
| 5,190,471 | A | | 3/1993 | Barile et al. |
| 5,273,438 | A | | 12/1993 | Bradley et al. |
| 5,281,160 | A | | 1/1994 | Walkup et al. |
| 5,447,442 | A | | 9/1995 | Swart |
| 5,468,164 | A | | 11/1995 | DeMissy |
| 5,469,072 | A | | 11/1995 | Williams et al. |
| 5,533,693 | A | | 7/1996 | Abildskov, deceased |
| 5,564,931 | A | | 10/1996 | Fabian et al. |
| 5,565,654 | A | | 10/1996 | Zell et al. |
| 5,635,677 | A | | 6/1997 | Wood et al. |
| 5,645,459 | A | | 7/1997 | Fitting |
| 5,676,571 | A | | 10/1997 | Matthews |
| 5,769,656 | A | | 6/1998 | Bamburg |
| 5,880,402 | A | | 3/1999 | Nugent |
| 5,899,755 | A | | 5/1999 | Kline |
| 5,899,766 | A | | 5/1999 | DeFeo |
| 6,019,642 | A | * | 2/2000 | Nagata ..... 439/683 |
| 6,086,432 | A | | 7/2000 | Frinker et al. |
| 6,102,246 | A | | 8/2000 | Goulet et al. |
| 6,102,746 | A | | 8/2000 | Nania et al. |
| 6,135,783 | A | | 10/2000 | Rathburn |
| 6,210,771 | B1 | | 4/2001 | Post et al. |
| 6,250,966 | B1 | | 6/2001 | Hashimoto et al. |
| 6,264,476 | B1 | | 7/2001 | Li et al. |
| 6,313,523 | B1 | | 11/2001 | Morris et al. |
| 6,386,890 | B1 | | 5/2002 | Bhatt et al. |
| 6,388,885 | B1 | | 5/2002 | Alexander et al. |
| 6,439,894 | B1 | | 8/2002 | Li |
| 6,471,555 | B1 | | 10/2002 | Creze |
| 6,598,290 | B1 | | 7/2003 | Hembree et al. |
| 6,666,690 | B1 | | 12/2003 | Ishizuka et al. |
| 6,722,893 | B1 | | 4/2004 | Li et al. |
| 6,762,941 | B1 | | 7/2004 | Roth |
| 6,852,395 | B1 | | 2/2005 | Dhawan et al. |
| 6,942,496 | B1 | | 9/2005 | Sweetland et al. |
| 6,945,790 | B1 | * | 9/2005 | Sweetland ..... 439/67 |
| 6,951,465 | B1 | | 10/2005 | Sweetland et al. |
| 2004/0048500 | A1 | | 3/2004 | Sweetland et al. |
| 2004/0171284 | A1 | | 9/2004 | Sweetland et al. |
| 2004/0214454 | A1 | | 10/2004 | Sweetland et al. |
| 2005/0014421 | A1 | | 1/2005 | Sweetland |
| 2005/0045461 | A1 | | 3/2005 | Sweetland et al. |
| 2005/0130486 | A1 | | 6/2005 | Sweetland et al. |
| 2005/0159028 | A1 | | 7/2005 | Sweetland et al. |
| 2005/0202695 | A1 | | 9/2005 | Sweetland |

FOREIGN PATENT DOCUMENTS

| | | |
|---|---|---|
| EP | 0512714 | 11/1992 |
| EP | 0901191 | 3/1999 |
| EP | 0932172 | 7/1999 |
| JP | 61185818 | 8/1986 |
| JP | 6176624 | 6/1994 |
| JP | 6251819 | 9/1994 |
| JP | 7037433 | 2/1995 |
| JP | 8106939 | 4/1996 |
| WO | WO-95/08910 | 3/1995 |
| WO | WO-01/75788 | 10/2001 |

* cited by examiner

ELECTRICAL CONNECTOR HAVING ONE OR MORE ELECTRICAL CONTACT POINTS

BACKGROUND

1. Technical Field

The present invention is directed to an electrical connector, and more particularly to an electrical connector having one or more electrical contact points for providing an electrical connection to an inserted pin.

2. Discussion of Related Art

Electrical connectors can be used to interconnect components of electrical systems. These components can vary in size and complexity, depending on the particular electrical system. Regardless of the type of electrical system, advances in technology have led to electrical components that are increasingly smaller and more powerful. However, existing electrical connectors, in general, are relatively large compared to the sizes of such components. Furthermore, existing electrical connectors often engage a mating conductor of an electrical component by sliding, resulting in frictional forces between the electrical connector and the mating conductor. These frictional forces include asperity interactions, adhesion, and surface plowing.

Woven electrical connectors having one or more electrical contact points have been detailed, for example, in previous patent applications of Tribotek, Inc. (U.S. patent application Ser. Nos. 10/273,241, 10/375,481, 10/603,047, 10/619,210, 10/616,667, 10/889,542, and 10/985,322, the contents of which are incorporated by reference herein in their entireties).

SUMMARY

The present invention provides an electrical connector having one or more electrical contact points for providing an electrical connection to an inserted pin.

Under one aspect of the present invention, an electrical connector for providing an electrical connection to an inserted pin includes a spring made of electrically conductive material. The connector includes a loading element attached to the spring and arranged to define an opening for pin insertion. The spring is physically arranged relative to the loading element to create a tension on the loading element. The connector includes at least one conductive wire in electrical communication with the spring. The wire is wound around the spring and the loading element to provide one or more electrical contact points radially inward relative to a center of the opening. Insertion of the pin tensions the loading element such that the loading element generates a contact force at each contact point.

Under another aspect of the present invention, the loading element includes a nonconductive fiber. Under another aspect of the present invention, the loading element includes a conductive material. Under another aspect of the present invention, the loading element includes a metal-plated fiber.

Under another aspect of the present invention, the loading element is arranged to form a loop that defines the opening for pin insertion. The loop may reside, for example, in a plane defined by the spring.

Under another aspect of the present invention, the spring is substantially "C"-shaped and has a first end and a second end. The loading element has a first end and a second end respectively attached to the first end and second end of the spring. The loading element may, for example, be arranged to form a loop that defines the opening for pin insertion and resides in a plane defined by the spring.

Under another aspect of the present invention, the spring is substantially "U"-shaped and has a first end and a second end. The loading element has a first end and a second end respectively attached to the first end and second end of the spring. The loading element may, for example, be arranged to form a loop that defines the opening for pin insertion and resides in a plane defined by the spring.

Under another aspect of the present invention, the spring is a helical spring and has a first end and a second end. The loading element has a first end and a second end respectively attached to the first end and second end of the spring. The loading element may, for example, be arranged to form a loop that defines the opening for pin insertion.

Under another aspect of the present invention, the spring has a first end and a second end. The loading element is arranged to form a loop that defines the opening for pin insertion. The loading element has a first end and a second end respectively attached to the first end and second end of the spring. The first end of the spring approaches the second end of the spring when the pin is inserted through the loop of the loading element.

Under another aspect of the present invention, the spring defines a plane, and a depth of the spring as measured perpendicular to the plane is in a range of about 0.005 inches to about 0.040 inches.

Under another aspect of the present invention, a perimeter of the opening of the loading element prior to insertion of the pin is less than a perimeter of a transverse cross-section of the pin.

Under another aspect of the present invention, the opening of the loading element is configured to receive a pin having a diameter of about 0.005 inches to about 0.200 inches.

Under another aspect of the present invention, the at least one conductive wire is terminated onto the spring by at least one of soldering and welding.

Under another aspect of the present invention, the contact force generated at each contact point is in a range of about 1.0 gram to about 20.0 grams.

Under another aspect of the present invention, the at least one conductive wire is wound around the spring and loading element to provide ten to twenty contact points.

Under another aspect of the present invention, the at least one conductive wire includes one conductive wire defining a plurality of winds, each wind having the spring and loading element disposed within the wind.

Under another aspect of the present invention, the at least one conductive wire includes a plurality of conductive wires. Each conductive wire defines at least one wind, the at least one wind having the spring and the loading element disposed within the at least one wind.

Under another aspect of the present invention, the conductive wire has a diameter in a range of about 0.001 inches to 0.020 inches.

Under another aspect of the present invention, the electrical connector further includes a conductive lead or conductive post attached to the spring and configured for connection to an electrical component.

Under another aspect of the present invention, the opening of the loading element is configured to receive a pin having a curved contact mating surface. In one example, the pin has a substantially round mating portion.

Under another aspect of the present invention, a multiple-layer electrical connector for providing an electrical connection to an inserted pin includes a plurality of electrical connectors. The plurality of connectors are arranged along an axis passing through a center of an opening of each connector of the plurality of connectors.

Under another aspect of the present invention, an electrical connector assembly includes a pin having a mating portion with a contact mating surface and an electrical connector. Insertion of the mating portion of the pin tensions a loading element of the connector such that the loading element generates a contact force between the contact mating surface and a conductive wire of the connector at each contact point.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

The present invention provides an electrical connector having one or more electrical contact points for providing an electrical connection to an inserted pin. The electrical connector of preferred embodiments has a small profile and results in reduced frictional forces between the electrical connector and inserted pin.

In some embodiments of the present invention, the electrical connector includes a spring, a loading element, and at least one conductive wire. The spring of the electrical connector is a part of the electrical path of the connector and provides tension on the loading element to generate a contact force between the conductive wire and the inserted pin. An advantage of incorporating the spring into the electrical path, while also using the spring to provide the tensioning force on the loading element, is that the part count and complexity of the electrical connector of the present invention is reduced. In addition, the depth of the connector can be much smaller than in existing technology, allowing the connector of the present invention to be used in places where height is a major restriction.

The electrical connector of the present invention may be used, for example, for low to moderate power applications and data contacts, and for sensors such as Kelvin probes where low resistance is necessary, but no current carrying capability is required. In embodiments of the present invention in which the loading element is conductive (e.g., plated fiber, solid conductor), the multiple electrical paths can be better load balanced and the electrical connector may be used in applications requiring greater current carrying capability. In some embodiments, multiple electrical connectors of the present invention may be stacked, or layered, on top of one another to form a larger connector with greater current carrying capacity.

The following FIGS. 1–8 and their accompanying descriptions provide detailed examples of the electrical connector of the present invention.

Figure 1:
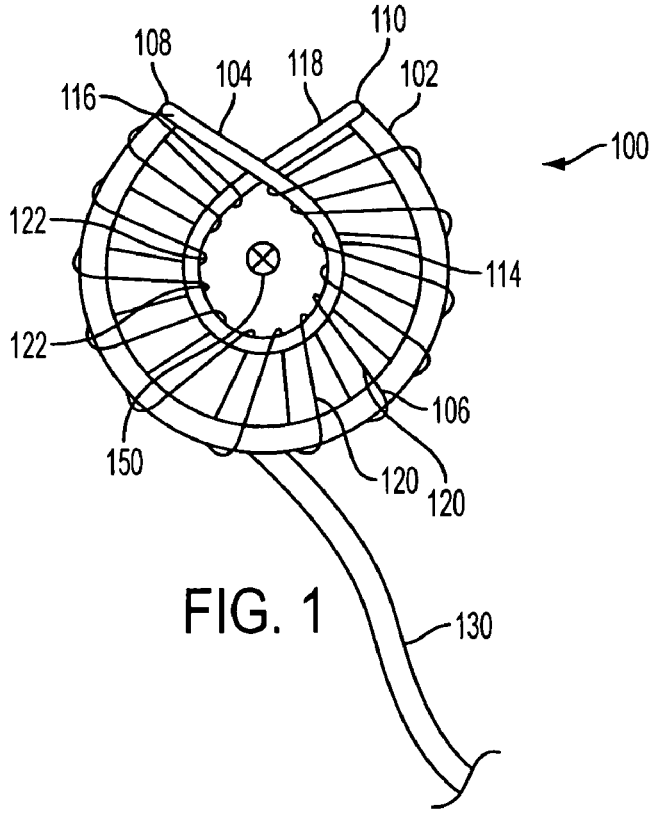
FIG. 1 is an elevational view of an illustrative electrical connector in accordance with some embodiments of the present invention.
Figure 2:
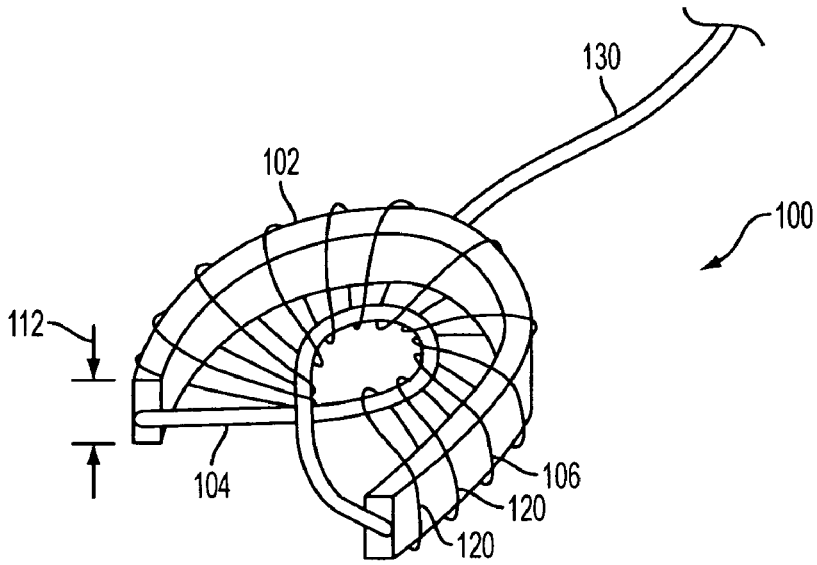
FIG. 2 is a perspective view of the electrical connector of FIG. 1 in accordance with some embodiments of the present invention.

FIG. 1 is an elevational view of an illustrative electrical connector 100 in accordance with some embodiments of the present invention. FIG. 2 is a perspective view of electrical connector 100. Connector 100 includes a spring 102, a loading element 104, and a conductive wire 106.

Spring 102 may be any suitable spring for creating a tension on loading element 104 and for forming part of the electrical path of electrical connector 100. Spring 102 may be shaped such that, when a pin is inserted into loop 114 of loading element 104 (as will be described hereinbelow), first end 108 and second end 110 advance radially inward toward the loop. For example, spring 102 may be a substantially "C"-shaped spring clip, a substantially "U"-shaped spring clip, a helical spring, or any other shape suitable for providing tension on loading element 104. As shown in FIGS. 1 and 2, for example, spring 102 is a substantially "C"-shaped spring clip. In another example, as shown in FIG. 4, spring 402 is a substantially "U"-shaped spring clip.

Figure 5:
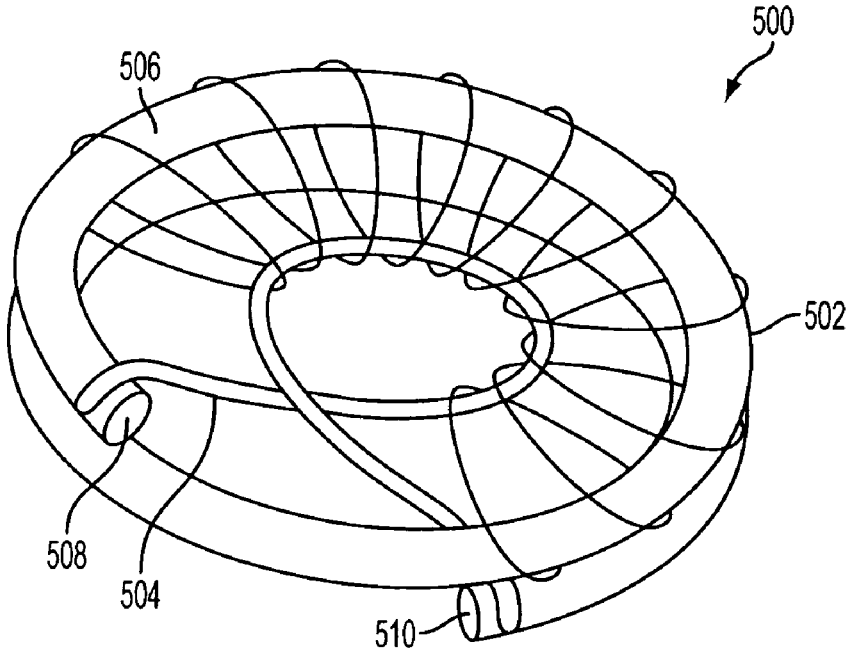
FIG. 5 is a perspective view of yet another illustrative connector in accordance with some embodiments of the present invention.

In yet another example, as shown in FIG. 5, spring 502 is a helical spring. As shown in FIG. 5, helical spring 502 includes approximately two turns. This example is merely illustrative, however, and spring 502 may include any suitable number of turns for a particular application. Due to the plurality of turns, helical spring 502 allows connector 500 to accommodate larger variations in mating pin diameter than a "C"-shaped or "U"-shaped spring clip. For example, in a "C"-shaped or "U"-shaped spring clip, the tolerance for a mating pin may be nominal diameter plus/minus about 0.001 inch. In a helical spring such as helical spring 502, for example, the tolerance for a mating pin may be nominal diameter plus about 0.003–0.004 inches, minus about 0.001 inch. As the number of the turns in the helical spring increases, the tolerance for mating pin size also increases (i.e., a helical spring having three turns has a greater tolerance for a mating pin than a helical spring having two turns).

Figure 4:
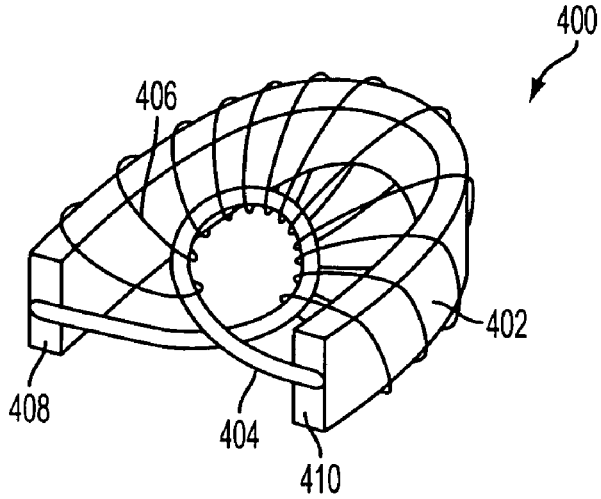
FIG. 4 is a perspective view of another illustrative connector in accordance with some embodiments of the present invention.

In the examples of FIGS. 4 and 5, springs 402 and 502, respectively, respond similarly to spring 102 of FIGS. 1 and 2 when a pin is inserted into the respective openings of loading elements 404 and 504. In particular, when a pin is inserted, first end 408 and second end 410 of spring 402 advance radially inward toward the opening of loading element 404. Similarly, first end 508 and second end 510 of spring 502 advance radially inward toward the opening of loading element 504 when a pin is inserted.

Referring back to FIGS. 1 and 2, spring 102 may be constructed of any suitable electrically conductive material. Such materials include, for example, bronze, phosphor bronze, beryllium copper, steel, stainless steel, any other suitable material, or any combination thereof. Spring 102 may be sized such that electrical connector 100 can be used in applications in which connector depth is a restriction. Spring 102 may have a depth 112 (FIG. 2) in a range of about 0.005 inches to about 0.040 inches. In some embodiments, spring 102 may have a depth in a range of 0.015 inches to 0.040 inches. Alternatively, spring 102 may have a depth in a range of 0.005 inches to 0.015 inches, 0.010 inches to 0.020 inches, 0.015 inches to 0.025 inches, 0.020 inches to 0.030 inches, 0.025 inches to 0.035 inches, 0.030 inches to 0.040 inches, or any other suitable range. These dimensions, and any other dimensions provided herein, are merely illustrative. Spring 102 and any other components of the present invention (e.g., loading element 104, conductive wire 106, etc.) may be constructed with any desired dimensions depending on the particular application.

Loading element 104 is attached to spring 102 and defines an opening for pin insertion. When a pin is inserted into the opening of loading element 104, the loading element is tensioned by spring 102 and generates contact forces between conductive wire 106 and the pin. These contact forces generated by loading element 104 provide electrical contact to the inserted pin.

Loading element 104 may be coplanar with spring 102. In the example of FIGS. 1 and 2, first end 116 of loading element 104 may be attached to first end 108 of spring 102, and second end 118 of the loading element may be attached to second end 110 of the spring. Loading element 104 may be attached to ends 108 and 110 of spring 102 using any suitable means, including, for example, bonding, gluing, crimping, any other suitable attachment means, or any combination thereof. Loading element 104 may form a loop 114 that defines the opening for inserting a pin. When a pin having a perimeter greater than the perimeter of loop 114 is received in the loop, the loop may expand such that loading element 104 is tensioned by spring 102. Loading element 104 may receive a pin having a substantially round mating portion with a diameter in a range of about 0.005 inches to about 0.200 inches. In some embodiments, loading element 104 may receive a pin having a substantially round mating portion with a diameter in a range of 0.010 inches to 0.020 inches. Alternatively, the diameter of the pin may be in a range of 0.005 inches to 0.050 inches, 0.025 inches to 0.075 inches, 0.050 inches to 0.100 inches, 0.075 inches to 0.125 inches, 0.100 inches to 0.150 inches, 0.125 inches to 0.175 inches, 0.150 inches to 0.200 inches, or any other suitable range. Loading element 104 may have a diameter in a range, for example, of about 0.003 inches to about 0.015 inches.

In one aspect of the present invention, loading element 104 may be a nonconductive fiber constructed of any suitable nonconductive material. Such nonconductive materials include, for example, Kevlar®, aramid, paraaramid, amid, paraamid, cotton, Teflon®, any other suitable fiber, or any combination thereof. In another aspect of the present invention, loading element 104 may be conductive. For example, loading element 104 may be a plated fiber, a high-flex metal wire, a metal wire bundle, or any other suitable conductive element. In aspects of the invention in which loading element 104 is conductive, connector 100 may have a greater current carrying capability than aspects in which the loading element is nonconductive.

Conductive wire 106 is in electrical communication with spring 102. Wire 106 is wound around spring 102 and loading element 104 to provide one or more electrical contact points 122 radially inward of loop 114. In one example, conductive wire 106 may be wound multiple times around spring 102 and loading element 104, forming a plurality of winds 120. Winds 120 are terminated onto spring 102 to provide for electrical communication between conductive wire 106 and the spring. To maintain electrical communication with spring 102 both when the spring is relaxed and when a pin is inserted into loop 114, wire 106 may be terminated onto the spring using a mechanical bond. For example, wire winds 120 may be terminated onto spring 102 using any suitable termination means, including, for example, soldering, welding, any other suitable termination means, or a combination thereof.

Figure 6:
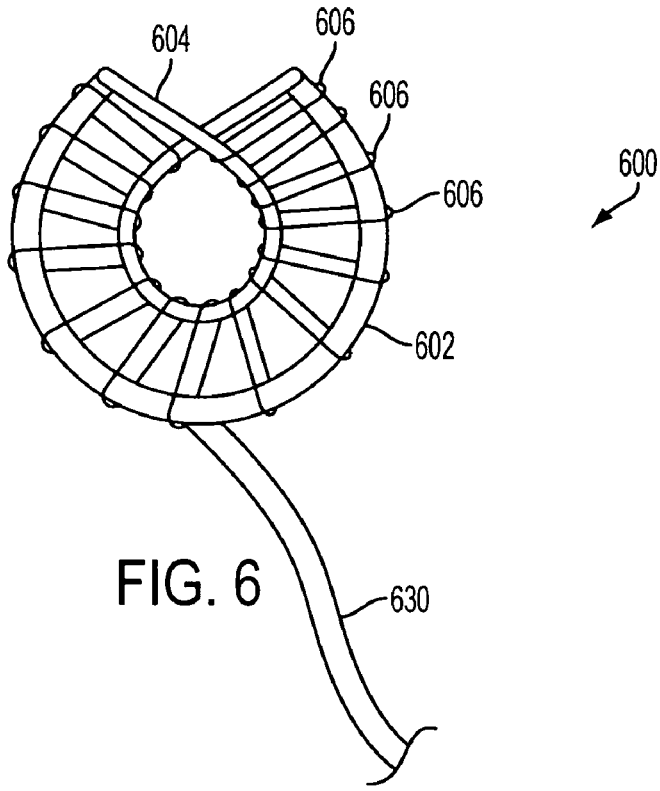
FIG. 6 is an elevational view of yet another illustrative electrical connector in accordance with some embodiments of the present invention.

The example of FIGS. 1 and 2 illustrates a single conductive wire 106 wound around spring 102 and loading element 104 for multiple winds. However, this example is merely illustrative, and the electrical connector of the present invention may include a plurality of conductive wires wound around the spring and loading element one or more times. For example, as shown in FIG. 6, an electrical connector 600 is illustrated having a plurality of conductive wires 606, each wound around spring 602 and loading element 604 for a single wind. Alternatively, plurality of conductive wires 606 may each be wound around spring 602 and loading element 606 for more than one wind.

In some embodiments, conductive wire 106 may be wound around loading element 104 multiple times for each wrap around spring 102. For example, conductive wire 106 may be wound from spring 102 to loading element 104, wound around the loading element for a plurality of winds, and then wound back to the spring 102. This configuration provides multiple contact points 122 for each wrap of conductive wire 106 around spring 102.

Referring back to FIGS. 1 and 2, when a pin is inserted into loop 114, loading element 104 is tensioned by spring 102, thereby generating contact forces at contact points 122. The contact forces generated by loading element 104 at contact points 122 provide electric contact to the inserted pin. The contact forces generated by loading element 104 may be in a range, for example, of about 0.5 grams to about 20.0 grams. In some embodiments, the contact force may be in a range of 1.0 gram to 2.0 grams. Alternatively, the contact force may be in a range of 0.5 grams to 5.0 grams, 2.5 grams to 7.5 grams, 5.0 grams to 10.0 grams, 7.5 grams to 12.5 grams, 10.0 grams to 15.0 grams, 12.5 grams to 17.5 grams, 15.0 grams to 20.0 grams, or any other suitable range.

In some embodiments, the number of contact points 122 may depend on the size of pin to be inserted into loop 114. For example, for interaction with pins having larger mating portions, connector 100 may include a greater number of contact points 122. For example, for interaction with a substantially round pin having an outer diameter of about 0.040 inches, connector 100 may include approximately 15 to 20 contact points 122.

Figure 3:
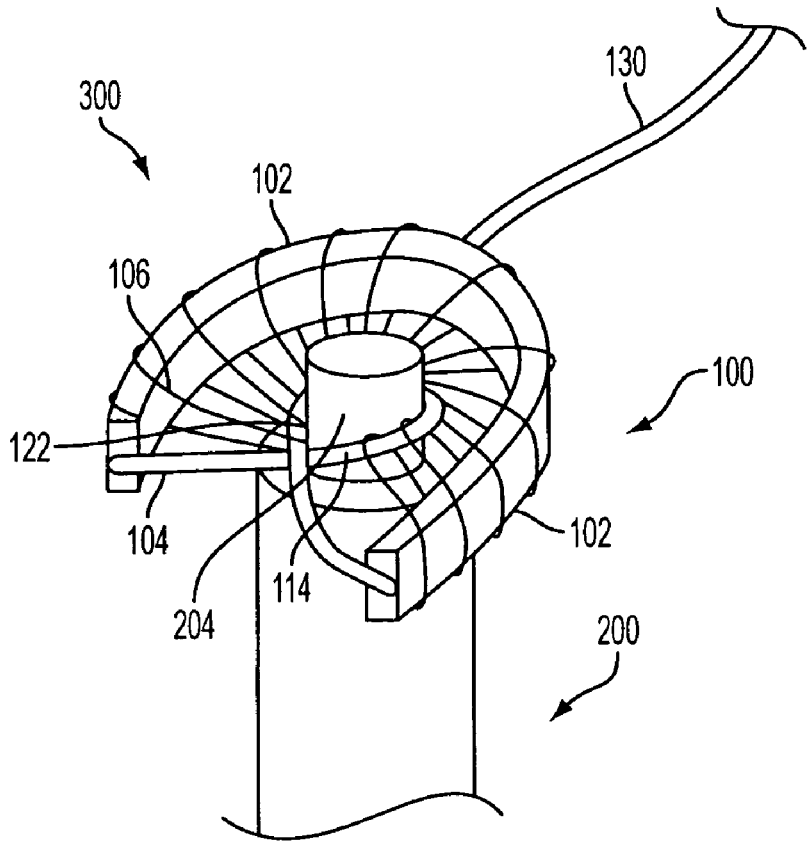
FIG. 3 is a perspective view of the electrical connector of FIG. 1 and an inserted pin in accordance with some embodiments of the present invention.

FIG. 3 is a perspective view of an electrical connector assembly 300 including electrical connector 100 engaged with a pin 200 in accordance with some embodiments of the present invention. As shown in FIG. 3, mating portion 202 of pin 200 may be inserted into loop 114 of loading element 104. Prior to insertion of mating portion 202 into loop 114, loading element 104 may be described as being in an "unstressed" configuration. In other words, spring 102 of connector 100 may be applying little or no tension on loading element 104 in the unstressed configuration. After inserting mating portion 202 into loop 114, loading element 104 may be described as being in a "stressed" configuration. In other words, in the stressed configuration, spring 102 applies a tensioning force on loading element 104. This tensioning force results in the generation of contact forces between contact points 122 and mating surface 204 of mating portion 202. To generate the stress on loading element 104, and the resultant contact forces, the perimeter of mating portion 202 of pin 200 may be greater than the perimeter of loading element 104 in the unstressed configured. The difference in perimeters results in an expansion of loop 114 when mating portion 202 is inserted into the loop.

When mating portion 202 is inserted into loop 114, mating portion 202 and contact points 122 of connector 100 are in electrical contact. As described hereinabove in connection with FIGS. 1 and 2, conductive wires 106 are terminated onto spring 102. Accordingly, the electrical path of connector 100 includes both conductive wires 106 and spring 102.

Figure 7:
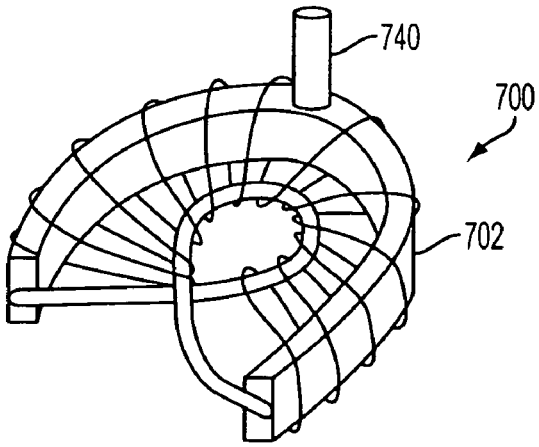
FIG. 7 is a perspective view of yet another illustrative electrical connector in accordance with some embodiments of the present invention.

In some embodiments of the present invention, the conductive path of connector 100 may also include a conductive lead 130. Conductive lead 130 may be attached to spring 102. Conductive lead 130 may facilitate electrical connection of connector 100 to an electrical component such as an external circuit or contact. Conductive lead 130 is merely illustrative, and electrical connector 100 may include any suitable means for connection to an electrical component. For example, as shown in FIG. 7, electrical connector 700 includes a mounting post 740 attached to spring 702 to facilitate electrical connection of connector 700 to an electrical component.

Figure 8:
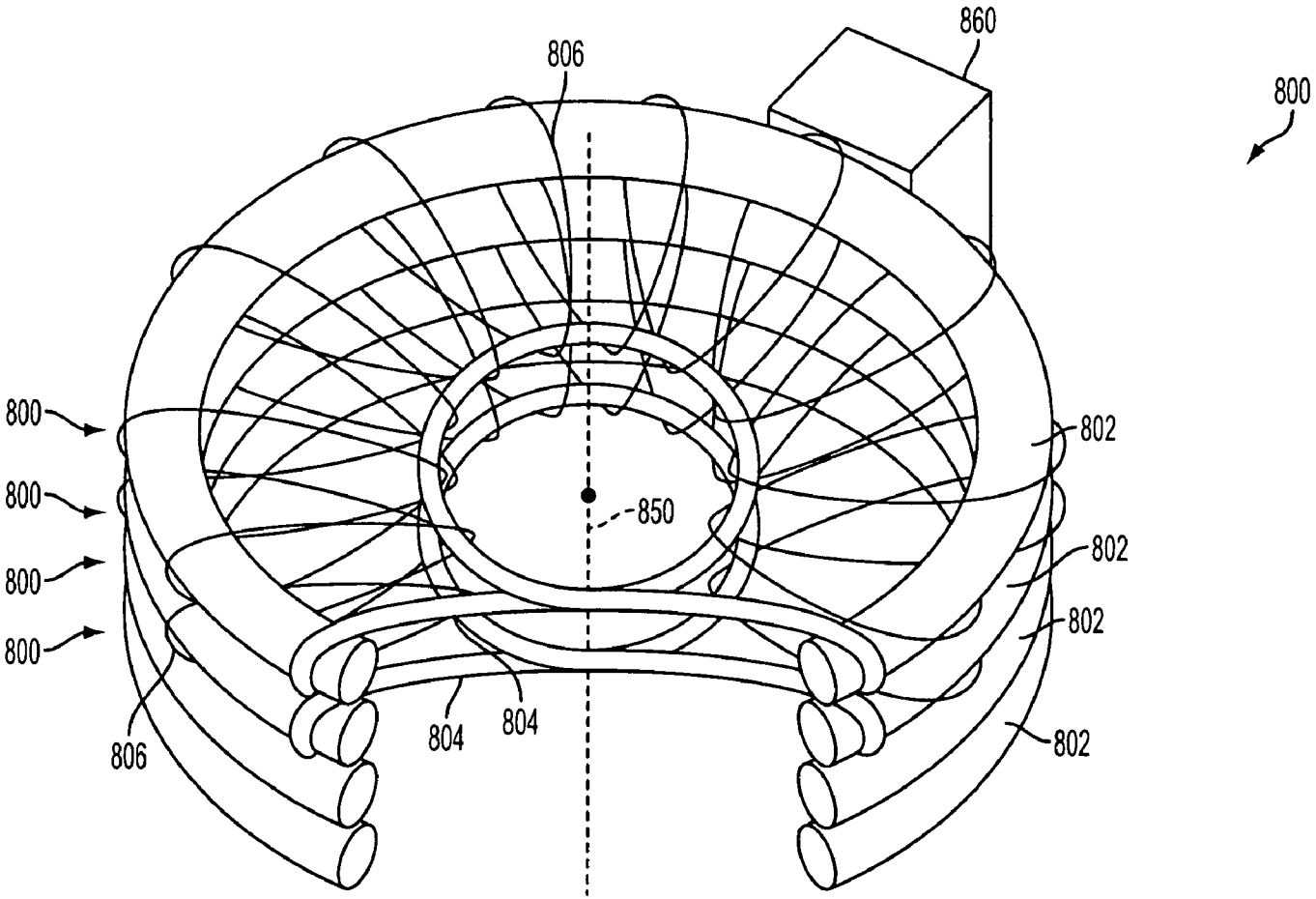
FIG. 8 is a perspective view of an illustrative stack of electrical connectors in accordance with some embodiments of the present invention.

It should be noted that a plurality of the connectors of the present invention may be arranged along a common axis to form a multiple-layer connector. FIG. 8 shows an illustrative stack 801 of electrical connectors 800. Each connector 800 includes a spring 802. Some or all of connectors 800 may include a loading element 804 and conductive wire 806 wound around spring 802 and the loading element, depending on the desired current carrying capability of stack 801. In the example of FIG. 8, two of the connectors 800 include a loading element 804 and conductive wire 806. Connectors 800 may be arranged along an axis 850 that extends axially through the opening of each loading element 804. Stack 801 may be formed by mounting (e.g., soldering, welding, etc.) each of the connectors 800 to a mounting post 860. Alternatively, in an example in which each spring 802 is wound with conductive wire 806, each of the conductive wires may be terminated to a common post or contact (not shown).

The electrical connector of the present invention may be manufactured using any suitable manufacturing techniques. An exemplary method of manufacture, for illustration only, is provided as follows. It should be noted that although this method is described in connection with a particular embodiment of electrical connector, one of skill in the art will realize that the method may be used to manufacture an electrical connector of the present invention having a different configuration than described hereinbelow.

The spring of the electrical connector of the present invention (e.g., spring 102) may start out, for example, as a straight rod or straight stamped spring. Spacers bars are laid along the top and bottom of the spring. In embodiments in which the loading element of the connector is a nonconductive fiber, the loading element may be laid along the top or bottom of the spring so that it does not have to be inserted into the wire winds as a separate step. Conductive wire (e.g., conductive wire 106) is spiral wound around the assembly of the spring and spacer bars for a desired number of winds required for a particular application. In some embodiments, the conductive wire may be plated. For example, for a copper conductive wire, the wire may be plated. For applications of the present invention requiring a small profile, gold or silver wire (e.g., 0.001 inch diameter or less) may be used, which does not require plating.

On a portion of the spring where the conductive wire contacts the spring, a small amount of solder paste, for example, is applied to both the wire and spring. The solder paste is only applied to one side of the spring so that, when heated, the solder will only bond the wire on one side of the spring. The spring is then heated until the solder flows and forms a strong mechanical and electrical bond between the portion of the spring and the conductive wire. To avoid bonding the spacers to the spring or conductive wire, the spacers may be constructed of either a non-wetting material to which the solder will not bond, or the spacers may be masked such that no solder contacts the spacers.

The spacers are removed and a loading element (e.g., loading element 104) is inserted into one of the spaces left over from removing the spacers. Alternatively, and as described hereinabove, a nonconductive loading element may have been laid along the top or bottom of the spring prior to bonding the conductive wire to the spring. The assembly of the spring, wire, and loading element is then formed around a forming pin to produce the desired shape (e.g., a "C"-shaped spring, a "U"-shaped spring, a helical spring). The side of the spring that is bonded to the wire may be oriented such that it forms the outside of the spring (e.g., the outside of the "C" shape, "U" shape, or turns of the helical spring). The assembly is then mounted onto a forming pin that has a fixed, controlled diameter. One end of the loading element is attached (e.g., crimped, bonded, glued) to one end of the formed spring. The other end of the loading element is pulled tight, which pulls the wires into contact with the forming pin and forms the loading element into a loop shape. The remaining loose end of the loading element is then attached to the other end of the spring (e.g., crimped, bonded, glued). The connector can then be attached to the desired termination means (e.g., signal wire, mounting post, etc.).

It will be understood that the foregoing is only illustrative of the principles of the invention, and that various modifications can be made by those skilled in the art without departing from the scope and spirit of the invention.

What is claimed is:

1. An electrical connector for providing an electrical connection to an inserted pin, comprising:

a spring made of electrically conductive material;

a loading element attached to said spring and arranged to define an opening for pin insertion, said spring being physically arranged relative to said loading element to create a tension on said loading element; and at least one conductive wire in electrical communication with said spring, said wire wound around said spring and said loading element to provide one or more electrical contact points radially inward relative to a center of said opening, wherein insertion of the pin tensions said loading element such that said loading element generates a contact force at each contact point.

2. The electrical connector of claim 1, wherein said loading element comprises a nonconductive fiber.

3. The electrical connector of claim 1, wherein said loading element comprises a conductive material.

4. The electrical connector of claim 1, wherein said loading element comprises a metal-plated fiber.

5. The electrical connector of claim 1, wherein said loading element is arranged to form a loop that defines said opening for pin insertion.

6. The electrical connector of claim 1, wherein said loading element is arranged to form a loop that defines said opening for pin insertion, said loop residing in a plane defined by said spring.

7. The electrical connector of claim 1, wherein said spring is substantially "C"-shaped and has a first end and a second end, said loading element having a first end and a second end respectively attached to said first end and said second end of said spring.

8. The electrical connector of claim 1, wherein said spring is substantially "C"-shaped and has a first end and a second end, said loading element is arranged to form a loop that defines said opening for pin insertion, said loading element having a first end and a second end respectively attached to said first end and said second end of said spring, said loop residing in a plane defined by said spring.

9. The electrical connector of claim 1, wherein said spring is substantially "U"-shaped and has a first end and a second end, said loading element having a first end and second end respectively attached to said first end and said second end of said spring.

10. The electrical connector of claim 1, wherein said spring is substantially "U"-shaped and has a first end and a second end, said loading element is arranged to form a loop that defines said opening for pin insertion, said loading element having a first end and a second end respectively attached to said first end and said second end of said spring, said loop residing in a plane defined by said spring.

11. The electrical connector of claim 1, wherein said spring is a helical spring and has a first end and a second end, said loading element having a first end and a second end respectively attached to said first end and said second end of said spring.

12. The electrical connector of claim 1, wherein said spring is a helical spring and has a first end and a second end, said loading element is arranged to form a loop that defines said opening for pin insertion, said loading element having a first end and a second end respectively attached to said first end and said second end of said spring.

13. The electrical connector of claim 1, wherein said spring has a first end and a second end, said loading element is arranged to form a loop that defines said opening for pin insertion, said loading element having a first end and a second end respectively attached to said first end and said second end of said spring, and wherein said first end of said spring approaches said second end of said spring when the pin is inserted through said loop of said loading element.

14. The electrical connector of claim 1, wherein said spring defines a plane, and wherein a depth of said spring as measured perpendicular to said plane is in a range of about 0.005 inches to about 0.040 inches.

15. The electrical connector of claim 1, wherein a perimeter of said opening of said loading element prior to insertion of the pin is less than a perimeter of a transverse cross-section of the pin.

16. The electrical connector of claim 1, wherein said opening of said loading element is configured to receive a pin having a diameter of about 0.005 inches to about 0.200 inches.

17. The electrical connector of claim 1, wherein said at least one conductive wire is terminated onto said spring by at least one of soldering and welding.

18. The electrical connector of claim 1, wherein said contact force generated at each contact point is in a range of about 1.0 gram to about 20.0 grams.

19. The electrical connector of claim 1, wherein said at least one conductive wire is wound around said spring and said loading element to provide ten to twenty contact points.

20. The electrical connector of claim 1, wherein said at least one conductive wire comprises one conductive wire defining a plurality of winds, each wind having said spring and said loading element disposed within said wind.

21. The electrical connector of claim 1, wherein said at least one conductive wire comprises a plurality of conductive wires, each conductive wire defining at least one wind, said at least one wind having said spring and said loading element disposed within said at least one wind.

22. The electrical connector of claim 1, wherein said conductive wire has a diameter in a range of about 0.001 inches to 0.020 inches.

23. The electrical connector of claim 1, further comprising a conductive lead or conductive post attached to said spring and configured for connection to an electrical component.

24. The electrical connector of claim 1, wherein said opening of said loading element is configured to receive a pin having a substantially round mating portion.

25. The electrical connector of claim 1, wherein said opening of said loading element is configured to receive a pin having a mating portion with a curved contact mating surface.

26. A multiple-layer electrical connector for providing an electrical connection to an inserted pin, comprising:

a plurality of electrical connectors, each connector of said plurality of connectors comprising:

a spring made of electrically conductive material;

a loading element attached to said spring and arranged to define an opening for pin insertion, said spring being physically arranged relative to said loading element to create a tension on said loading element; and at least one conductive wire in electrical communication with said spring, said wire wound around said spring and said loading element to provide one or more electrical contact points radially inward relative to a center of said opening, wherein insertion of the pin tensions said loading element such that said loading element generates a contact force at each contact point; and wherein said plurality of connectors are arranged along an axis passing through a center of said opening of each said connector.

27. A electrical connector assembly, comprising:

a pin having a mating portion with a contact mating surface; and an electrical connector, comprising:

a spring made of electrically conductive material;

a loading element attached to said spring and arranged to define an opening for inserting said mating portion of said pin, said spring being physically arranged relative to said loading element to create a tension on said loading element;

at least one conductive wire in electrical communication with said spring, said wire wound around said spring and said loading element to provide one or more electrical contact points radially inward relative to a center of said opening to provide electrical contact to said pin; and wherein insertion of said mating portion of said pin tensions said loading element such that said loading element generates a contact force between said contact mating surface and said conductive wire at each contact point.

* * * * *